United States Patent [19]

Tragesser

[11] 4,048,457

[45] Sept. 13, 1977

[54] CIRCUIT-INTERRUPTER GRID STRUCTURE FOR AN OIL-BREAK CIRCUIT INTERRUPTER

[75] Inventor: Charles W. Tragesser, Murrysville, Pa.

[73] Assignee: Westinghouse Electric Corporation, Pittsburgh, Pa.

[21] Appl. No.: 539,549

[22] Filed: Jan. 8, 1975

Related U.S. Application Data

[63] Continuation of Ser. No. 343,071, March 20, 1973, abandoned.

[51] Int. Cl.[2] ..... H01H 33/68

[52] U.S. Cl. ..... 200/150 R

[58] Field of Search ..... 200/150 R, 150 B

[56] References Cited

U.S. PATENT DOCUMENTS

| | | | |
|---|---|---|---|
| 3,080,467 | 3/1963 | Date | 200/150 R |
| 3,128,360 | 4/1964 | Rietz | 200/150 R |
| 3,201,552 | 8/1965 | Baldini | 200/150 R |
| 3,392,248 | 7/1968 | Rietz et al. | 200/150 R |
| 3,519,774 | 7/1970 | Rietz | 200/150 R |

*Primary Examiner*—Robert S. Macon
*Attorney, Agent, or Firm*—W. R. Crout

[57] ABSTRACT

An oil-type circuit-breaker has an improved grid structure for effecting quick extinction of the arc, which is established and lengthened within the grid structure by the separation of the rod-shaped movable contact downwardly away from the stationary-contact structure. The grid structure is constructed by providing a plurality of suitably-configured plate elements, constituting vent passages and oil pockets, within an outer cylindrical shell member. The stationary contact assembly is so arranged as to have a lengthened finger, which serves as an arcing horn, disposed adjacent the side lateral vent openings. The vent openings are formed by passages provided in the individual suitably-configured plate elements; and a splitter plate is interposed between the lateral vent passages and close to the path of movement of the movable contact rod. Additional lower-disposed oil pockets and a lower plug member having an entrance opening, assist in guiding the upward movement of the movable contact rod, and additionally provide considerable turbulence within the oil-grid structure during the opening operation.

12 Claims, 12 Drawing Figures

CIRCUIT-INTERRUPTER GRID STRUCTURE FOR AN OIL-BREAK CIRCUIT INTERRUPTER

This is a continuation of application Ser. No. 343,071, filed Mar. 20, 1973, now abandoned.

CROSS-REFERENCES TO RELATED APPLICATIONS

Applicant is not aware of any related application pertinent to the present invention.

BACKGROUND OF THE INVENTION

As well known by those skilled in the art, in providing oil-type circuit interrupters it has been common practice to provide interrupter grid structures formed by stacking a plurality of suitably-configured plate elements. As typical of such prior-art structures, reference may be made to U.S. Pat. No. 3,646,296, issued Feb. 29, 1972, to Robert L. Hess and Gerald D. Summers, and assigned to the assignee of the instant application. Such a grid structure provides oil pockets and side lateral vent passages, all having the function of creating turbulence and providing an exhausting lateral venting action to assist in extinguishing the arc, which is established and lengthened within the grid structure by the downward opening separating movement of a rod-shaped movable contact away from an upper-disposed stationary finger contact structure.

As descriptive of additional prior-art constructions, reference may also be made to U.S. Pat. No. 3,356,811, issued Dec. 5, 1967, to George B. Cushing and Frank L. Reese, and also assigned to the assignee of the present invention.

SUMMARY OF THE INVENTION

According to a preferred embodiment of the present invention, there is provided an improved plate structure providing improved oil-pocket arrangements and increased turbulence, with a highly-effective lateral venting action of the arc-exhaust gases and products to provide improved interruption for both high and low currents, and additionally and very importantly, providing improved dielectric strength along the arcing passage following an arc interruption to prevent restriking of the extinguished arc. As well known by those skilled in the art, such restriking is very undesirable, as it prolongs the arcing time, and additionally provides increased pressure within the grid structure, which, obviously, is also an undesirable incident.

The present invention is concerned with the provision of improved configured insulating plate elements providing at least three lateral venting passages leading out of the interrupter grid structure, and, in addition, providing a plurality of side splitter plates, which cause the arc to loop extensively around the splitter plates, and to elongate laterally within the side vent passages, thereby increasing the overall length of the arc, increasing the arc voltage, and bringing about its speedy interruption.

The lower plate elements are particularly configured and arranged to provide fast interruption of relatively low-current arcs, the interruption of which has always been a problem to those skilled in the art, because of the reduced gas pressure established within the grid structure by such low-amperage currents.

Further advantages will readily become apparent upon reading the following specification, taken in conjunction with the drawings.

DESCRIPTION OF THE PREFERRED EMBODIMENT

Figure 1:
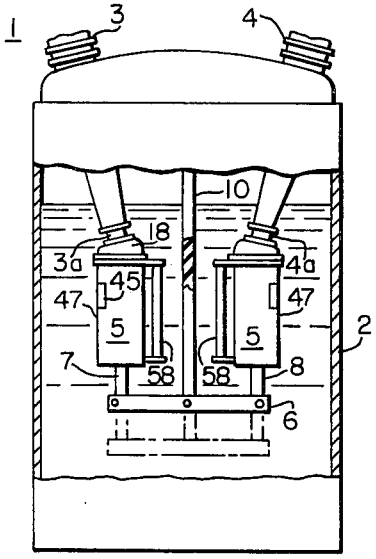
FIG. 1 is a side-elevational view, partly in vertical section, of a tank-type circuit interrupter illustrating two serially-related grid structures, and incorporating a preferred embodiment of the present invention, the contact structure being illustrated in full lines in the closed-circuit position.

Referring to the drawings, and more particularly to FIG. 1 thereof, the reference numeral 1 generally designates an oil-type circuit interrupter illustrating a tank 2, within which extends a pair of terminal bushings 3 and 4 having depended thereto, at the lower ends **3*a*, 4*a* thereof, interrupter grid units, designated by the reference numeral 5, and electrically interconnected by a cross-bar 6 having upstanding rod-shaped movable contacts 7, 8** secured thereto adjacent the outer ends thereof.

An insulating reciprocally-operable operating-rod 10 is vertically reciprocally-actuated by a suitable mechanism, not shown, and effects the simultaneous opening and closing operations of the two rod-shaped movable contacts 7, 8.

Figure 2:
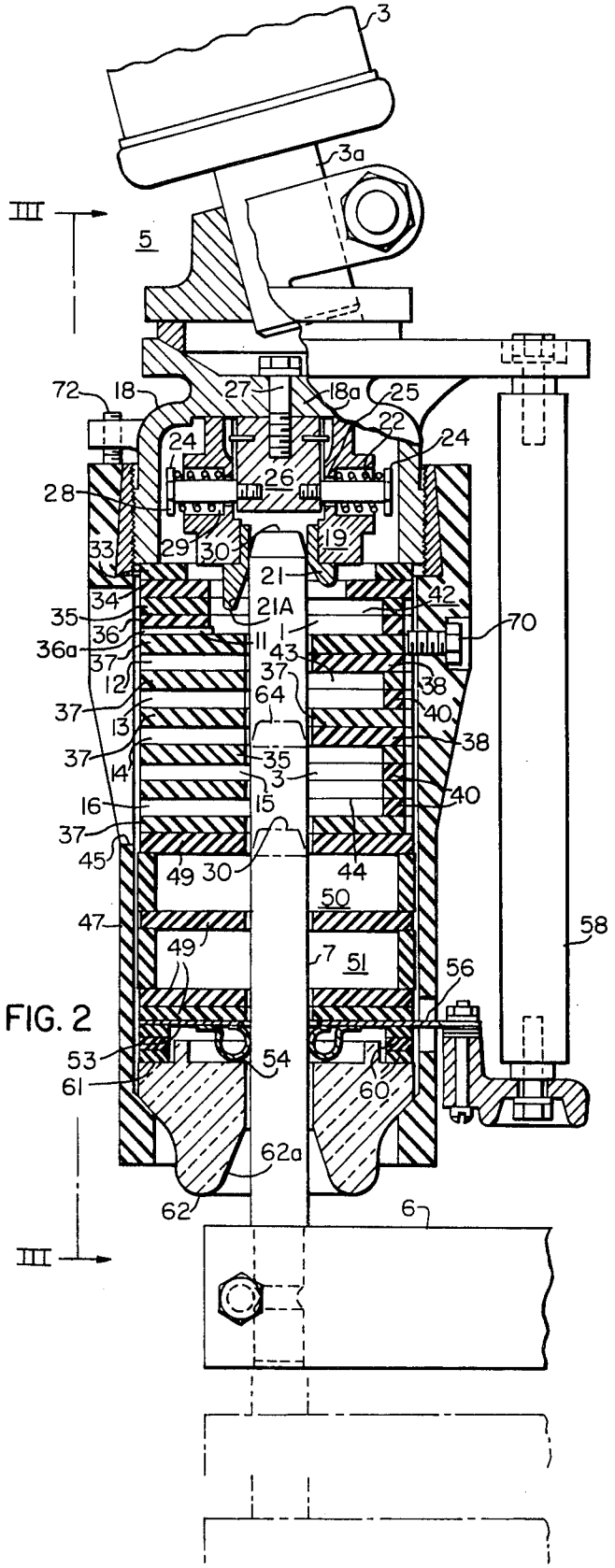
FIG. 2 is a considerably-enlarged vertical cross-sectional view of the left-hand grid structure of FIG. 1, the contact structure being shown in the closed-circuit position.

FIG. 2 illustrates the left-hand interrupting grid structure 5 of FIG. 1, the other one merely being a duplicate thereof, with the exception that the vent openings 11–16 are facing in the opposite direction. As shown in FIG. 2, it will be observed that there is provided an upper casting member 18 enclosing a stationary contact structure 19, in this instance comprising six finger contacts 21, each of which is biased inwardly by a plurality of compression springs 22. In more detail, each of the finger contacts 21 has a cap-bolt 24 passing through an opening 25 provided in the finger structure 21, and threadedly secured in a plug-type stationary contact support, designated by the reference numeral 26, and affixed by a bolt 27 to the upper dome portion **18*a* of the hollow casting member 18.**

The compression spring 22 is interposed between the cap portion **24*a* of each spring-bolt 24 and the base of the recess 29 provided in each finger contact 21, so that the finger contact 21 is biased radially inwardly into good contacting engagement with the upper tip portion 30 of the rod-shaped movable contact 7, as illustrated in FIG. 2** showing the closed-circuit position.

Figure 12:
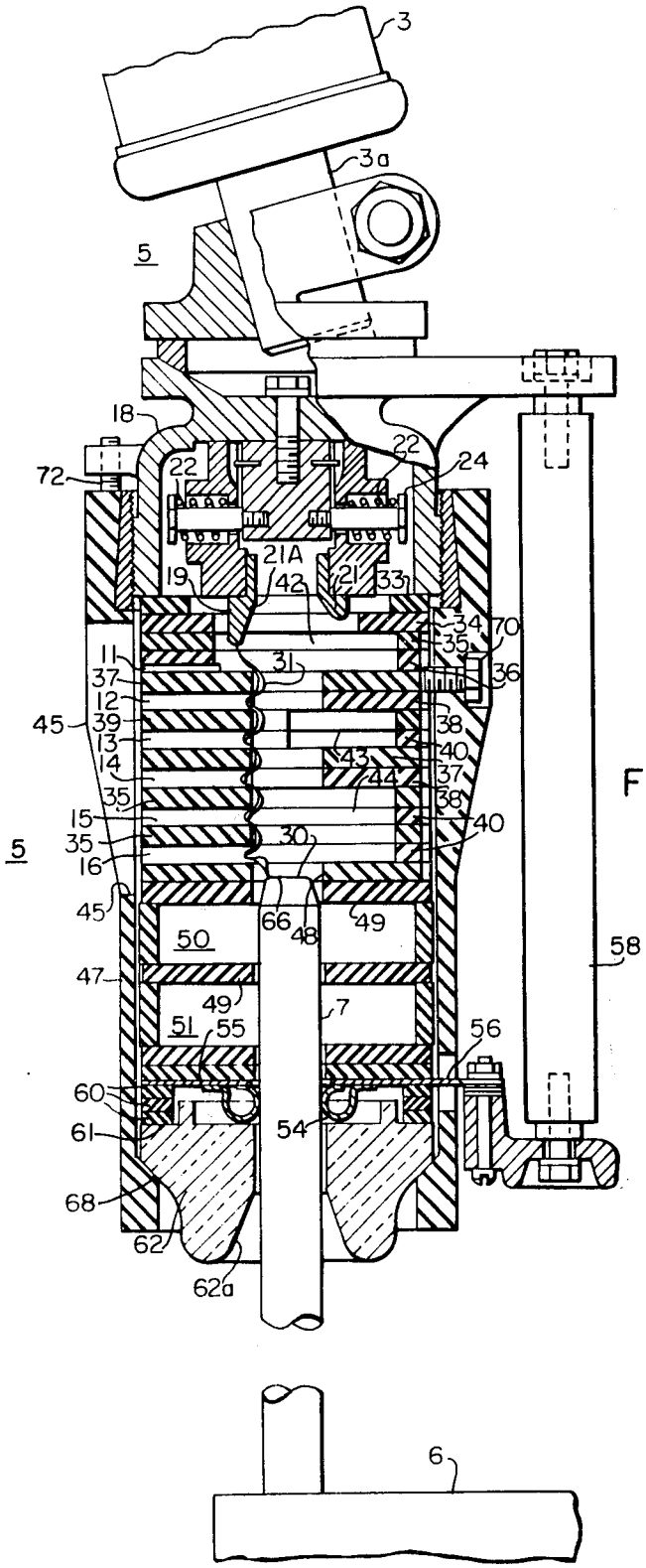

It will be noted that the finger-element 21A, which is positioned adjacent the upper vent opening 11, is of a greater length than the other finger contacts 21, and serves the function of initially establishing the arc 31 adjacent the lateral vent outlets 11–16, as shown in FIG. 12.

Figure 4:
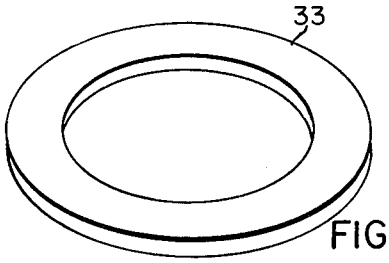
FIGS. 4–11 illustrate, in perspective, individual detailed plate elements, which, when stacked together, constitute the improved grid structure of the present invention; and, FIG. 12 illustrates, in vertical section, the interruption of relatively low-current arcs.
Figure 5:
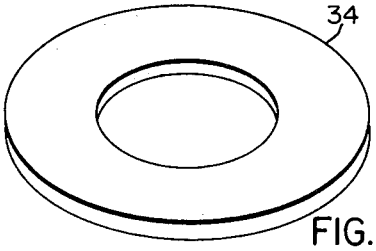

The grid structure 5 is formed of a plurality of stacked plate elements 33–40, the following description being set forth considering the plate elements beginning at the top and considering their position and function down toward the lower end of the grid structure 5. As shown, the top plate element 33 (FIG. 4) is generally ring-shaped and accommodates the finger contacts 21, 21A. Then follows plate element 34, the detailed configuration of which is illustrated in FIG. 5 of the drawings. Then follows plate element 35, shown in detail in FIG. 6. Below plate element 35 is a plate element 36 of generally the same configuration, but having a lower laterally-extending recess portion 36*a*, which forms the relatively small lateral vent opening 11. FIG. 7 shows the vent opening 11 in more detail.

Below plate element 36 is a washer-shaped plate element, designated by the reference numeral 37, shown in FIG. 8, which closely surrounds the movable contact 7, and by so doing provides an upper oil-pocket chamber, designated by the reference numeral 42, and herein termed a "first" oil pocket.

Figure 9:
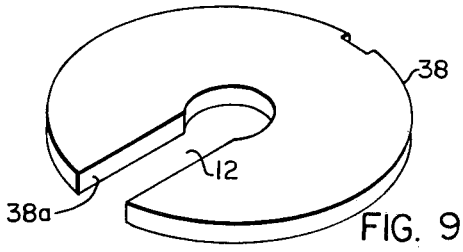
Figure 10:
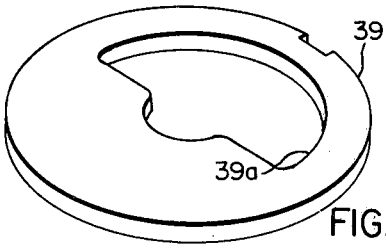

Below washer-shaped plate element 37 is another plate element, designated by the reference numeral 38, and more clearly illustrated in FIG. 9 of the drawings. Plate element 38 provides the lateral vent channel 12 by having a portion 38*a* of the plate 38 cut out therefrom. It will be observed, with attention being directed to FIG. 10, that an arcuately-shaped portion 39*a* of the plate 39 is removed to assist in providing a "second" oil chamber 43, which, by virtue of the presence of the lateral vent passages 12, 13, leads to a vent opening 45 provided in the outer surrounding cylindrical shell-member 47 to the region externally of the grid-unit. Then follows a vent plate 40, shown in FIG. 11, and providing a vent channel 13 by the removal of a plate portion 40*a* from the plate 40.

Figure 8:
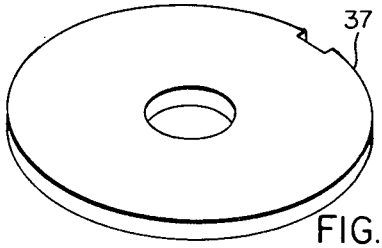
Figure 11:
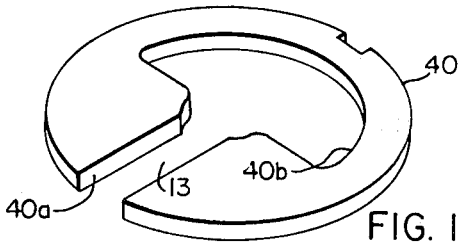

Then follows a washer-shaped plate designated by the reference numeral 37, and shown in more detail in FIG. 8 of the drawings. With reference to FIG. 11, it will be observed that the arcuate plate portion 40*b*, removed from the plate element 40, aligns with the removed portion 39*a* of the plate element 39 of FIG. 10, and collectively provide the "second" oil-pocket chamber 43.

Figure 6:
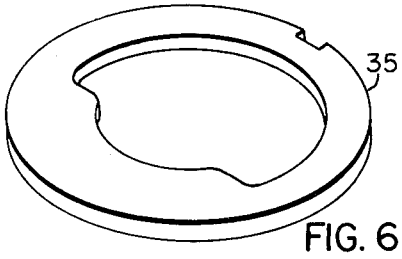
Figure 3:
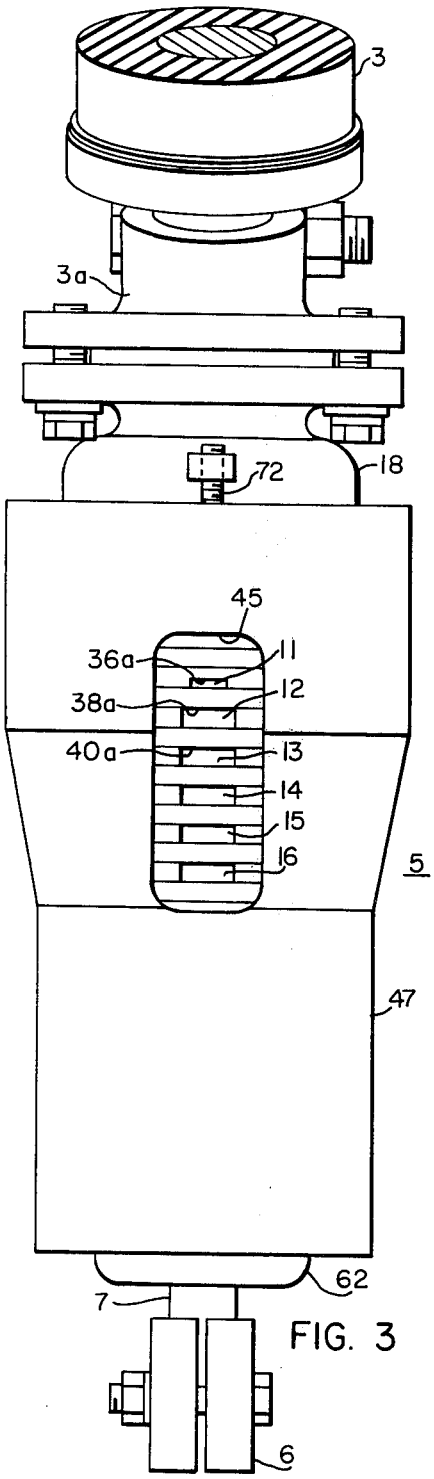
FIG. 3 is a side elevational view of the grid structure of FIG. 2, taken along the line III—III of FIG. 2 looking in the direction of the arrows.
Figure 7:
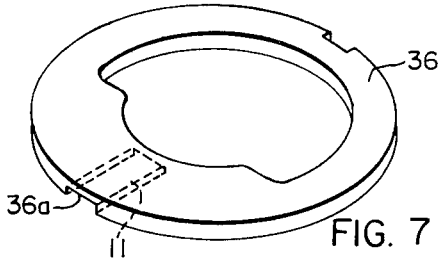

Below washer plate element 37 is provided a second venting plate 38 (FIG. 9), which is followed by a pocket-shaped plate element 35 (FIG. 6). Then follows a vent plate 40, another pocket plate 35, vent plate 40, and a lower washer-shaped plate element 37. The vent passage 15, associated with the plate element 40, provides an upper lateral vent opening for the "third" oil-pocket chamber, designated by the reference numeral 44, and comprising a plurality of plate elements 35 and 40, as illustrated in the sectional view of FIG. 12.

An additional washer-shaped plate element 37 closes the lower end of the "third" oil-pocket chamber 44, and closely encircles the rod-shaped movable contact 7. Then follows an additional washer-shaped plate element 49, which serves as the top of two closed annular oil chambers, designated by the reference numerals 50 and 51, being separated by an intervening washer-shaped plate element 49, thereby constituting the two adjoining segregated closed oil-chamber pockets 50 and 51.

Then follows two lower washer-shaped plate elements 49 and a metallic plate element 53, carrying a loop-shaped resistor contact 54, which bears upon the side of the movable contact 7, and has an external connection 56 leading to an externally-located resistor tube 58 extending longitudinally externally of the grid structure 5.

Then follows three resilient ring-shaped plate elements 60, preferably formed of a resilient oil-resistant material such as neoprene, for example, which rest upon a ledge portion 61 provided at the outer periphery of a lower insulating guide-plug 62 formed of a molded glass-polyester composition. The function of the lower plug element 62 is to serve as a guide means to assist in guiding the movable contact structure 7 up into the grid-unit 5 during the closing operation. The beveled guide portion 62*a* additionally assures that the upper tip 30 of the bayonet rod-shaped movable contact 7 enters the grid-structure 5, and assists in permitting relatively close tolerances to be provided between the plate elements 37, 38, 48, 49 and the movable contact 7.

During the interruption of relatively high currents, such as, for example, 20,000 to 30,000 amperes, the interruption is obtained in 4 cycles or less, and the arc 31 (FIG. 12) is extinguished by the time the tip 30 of the movable contact 7 has reached the dotted lines 64 of FIG. 2.

For relatively low-current interruption, say for example, 1000 to 5000 or 6000 amperes, interruption occurs when the tip 30 of the movable contact 7 reaches the position designated by the full lines 66 of FIG. 12.

The outer cylindrical shell 47 is formed, preferably of a filament-wound glass-epoxy material having the requisite strength, and providing a lower shelf portion, designated by the reference numeral 68, upon which the stacked plate elements may rest upon and be compressed.

The exact method of interruption of low-currents is not known with precision, but it is believed that during low-current interruption, pressure builds up within the upper first oil-pocket chamber 42 with a little pressure being exhausted through the vent opening 11 of FIG. 2. However, it is believed that the main interrupting effect, during low-current interruption, is provided through vents 15 and 16, and it will take the bayonet contact 7 the full stroke to build up enough pressure to put the low-current arc out and to enable the second and third oil pockets 43 and 44 to provide oil pressure enough to force the arc out of the vents 14 through 16 inclusive. It is believed that oil pocket chamber 44 is the final oil pocket for low-current interruption. As the oil pockets are separated, they constitute discrete volumes in themselves, and the clean oil of one oil-pocket chamber does not interact with the clean oil provided in the adjacent oil-pocket chamber. Pockets are thus separated so that there is always clean oil; and the arcing-residue products from earlier arcing does not affect the dielectric strength of the lower-disposed oil pockets, which are segregated, as the stroke of the movable contact 7 is continued.

Oil-pocket chamber 50 and 51 are somewhat "dead" spaces, that again keep the oil pockets separated, such that a minimum of arc products are infiltered into adjacent oil pockets, and cleaner oil is always provided to aid in arc interruption, and prevent the recovery voltage from effecting restriking of the extinguished arc 31.

The bayonet-shaped movable contact 7 acts somewhat as a sliding valve. The first and second vents 11, 12, when the movable contact is in that position, are the only vents which are opened to the tank, and as the bayonet contact slides downwardly from vent 11 through vent 16, successive openings of venting area are available for the arc 31 (FIG. 12) to loop out, and to enable clean oil to move into intimate contact with the arc. Also, considerable arc turbulence results from the venting of the oil out of the successive oil chambers laterally through the vent passages 11–16.

Oil-expansion pocket 42 is the main source of oil volume for the high-current interruptions. There is enough pressure generated in the oil pocket 42 that high-current interruptions are thus effectively brought about. The larger oil pocket 44 in this instance is not effective as a high-current interruption. It merely serves as a flushing action to flush the residue of the arc products out of the grid 5 as the bayonet contact 7 continues to open.

As mentioned hereinbefore, the elongated arcfinger contact 21A is positioned close to the upper vent opening 11, and it is the last finger contact to "break" with the tip portion 30 of the movable contact 7, and thereby effectively controls the initiation of the arc position, so that it is not in a random position within the grid structure 5, but is always located close to the vent 11, and thereby provides a looping action of the arc into the vent passages, as indicated in FIG. 12.

It will be noted that the upper vent opening 11 is very close to the arc finger 21A, and the purpose of this upper relatively-restricted vent 11 is two-fold. During the closing operations of the interrupter, when prestriking does occur, the upper relatively restricted vent opening 11 relieves the pressure build-up from pre-striking, and relieves this pressure inside the grid unit, thereby permitting facilitated closing. Also, during the opening operation, the upper restricted vent opening 11 aids somewhat in interruption.

It will be observed that the washer-shaped plate elements 37, 38, and 49 serve a guiding function of the moving contact 7, so that accurate closing engagement with the relatively stationary contact fingers 21 is achieved during the closing operation. The laterally-disposed resistors 58, in parallel with the arcs 31, serve, it is believed, only as a voltage-dividing means, and do not appreciably aid in arc interruption in any way.

By way of example, the voltage rating of the oil circuit-breaker described may be 69 KV with two breaks per phase. The MVA rating may be, for example, 2,500 or, alternatively, 3,500 MVA.

The purpose of the oil pockets 50, 51 is to eliminate the possibility of restriking after an interruption has occurred. As well known by those skilled in the art, in many cases when an oil circuit-breaker interrupts the arc, it will restrike a half-cycle later, and then finally interrupts completely. The discrete oil pockets 42, 43 and 44, provided within the improved interrupter described, together with their discrete oil chambers, provide the dielectric capability to prevent restriking, once arc interruption has occurred.

Test results show that the maximum interrupting current, which has been interrupted by an arc-grid unit of the type described, has been 33,000 amperes.

The interrupter grid assembly is a cemented assembly comprising a plurality, in this instance 13, fiber plates stacked and cemented and later machined. The resistor 58 and the grid assembly are finally assembled into the interrupter tube 47, and keyed into place with the bolt 70. All of the parts of the interrupter are put into compression during assembly by the three resilient washer members 60 at the bottom of the grid. I prefer to use neoprene washers for this purpose. The resistor-contact assembly includes a contact clip 54, preferably formed of a phosphor-bronze alloy, that is brazed to the copper-based ring 55. This allows continuous contact between the resistor contact 54 and the side of the moving contact 7 during the entire travel of the moving contacts. The magnitude of the resistor element 58 is 250 megohms per interrupter, or a total of 500 megohms per phase. Whereas most of the plate elements in the interrupter are stamped fiber, stamped out of sheet-fiber material, the lower guide-plug 62 is of a molded glass-polyester composition, for example. This guides the moving contact 7 during the closing operation, and permits close tolerances between the moving contact and the washer-shaped plate elements within the stack. A set screw 72 is used as a lock to prevent the interrupter shell 47 from unscrewing from the casting 18 after it has been assembled thereto.

From the foregoing description, it will be apparent that there has been provided an improved oil-grid structure 5, formed of a plurality of suitably-stacked plate elements, and providing an improved oil-expansion chamber arrangement with improved lateral venting action. Lateral splitter plates assist in forcing a looping of the arc 31 to occur into the several vent passages 11–16, thus lengthening the arc, and attenuating it sufficiently to bring about its interruption. Because of the discrete separated oil-pocket chambers 42, 43, 44 provided, dielectric strength within the grid-unit 5 is improved and restriking during the opening operation is prevented.

Although there has been illustrated and described a specific oil-grid structure, it is to be clearly understood that the same was merely for the purpose of illustration, and that changes and modifications may readily be made therein by those skilled in the art, without departing from the spirit and scope of the invention.

I claim:

1. A liquid-break type of circuit-breaker including a tank containing an arc-extinguishing liquid, a pair of terminal-bushings extending downwardly within said liquid-containing tank, each carrying an interrupter grid-unit (5), each grid unit (5) including at least three vertically segregated arc-extinguishing liquid chambers (42, 43, 44), means defining a first upper arc-extinguishing liquid chamber (42) particularly adaptable for interrupting high-amperage-value fault currents, said first chamber (42) being completely enclosed except for a lateral relatively-small vent opening (11), said first chamber (42) being partially defined by a lower-disposed valve plate (37) having only a small central opening provided therein, stationary contact means (19) disposed within said first chamber (42) including an elongated off-center finger contact (21A) extending downwardly close to said lateral restricted vent opening (11), a rod-shaped movable contact (7) movable upwardly and downwardly in its closing and opening movements and cooperable with said elongated stationary finger contact (21A) to establish an arc initially wholly within said first arc-extinguishing liquid chamber (42) while blocking said central opening (37) with valve action, means defining a second liquid interrupting chamber (43) disposed below said first chamber (42) and having said valve plate (37) forming its upper end, said second chamber (43) having at least two lateral vent openings (12, 13) in alignment with said first-mentioned restricted vent opening (11) and having at least one splitter plate (39) therebetween for effecting arc looping therearound into said two lateral vent openings (12, 13), said second chamber (43) being particularly adaptable for interrupting medium-value fault currents, a second valve plate (37) with a relatively-small central opening closing the lower side of said second interrupting chamber (43) with said movable rod contact (7) making valve action therewith, means defining a third interrupting chamber (44) disposed below said second chamber (43) and particularly adaptable for interrupting low-value currents and additionally having at least a pair of lateral vent openings (15, 16) therein also in alignment with the aforesaid vent openings (11, 12, 13), said third chamber (44) being located below said second-mentioned valve plate (37) and having its lower end closed by a third valve plate (49) having only a small central valve opening therein, a splitter plate disposed between the two lateral vent openings (15, 16) of the third interrupting chamber (44) to provide arc looping around the said last-mentioned splitter plate, again the movable contact-rod (7) making valve action with said last-mentioned valve-plate, at least one additional lowermost separate liquid completely-confined interrupting chamber (50, 51) for assisting in the interruption of the low-value-amperage currents having no lateral venting whatsoever, said lower-most additional liquid chamber (50, 51) having its upper and lower boundaries defined by valve-plates (49), and said interrupting unit 5 having a bottom apertured nozzle member (62) with a central orifice opening therein out of which the movable contact rod (7) moves at the end of the opening operation.

2. The combination according to claim 1, wherein each grid-unit (5) comprises a laminated-plate structure and a surrounding supporting interrupter cylinder (47).

3. The combination according to claim 1, wherein at least some of the liquid-interrupting chambers (42, 43, 44) are formed of stacked plates, at least some of which are formed of fiber material.

4. The combination according to claim 1, wherein a shunting resistor assemblage (58) is provided located externally of the grid-unit (5) to lower the rate-of-rise of the recovery-voltage transient during the opening operation.

5. The combination according to claim 4, wherein a spring clip (54) electrically connected to one end of the said resistor assemblage (58) makes sliding contacting engagement with the movable contact-rod (7) during the opening operation.

6. The combination according to claim 2, wherein the interrupting cylinder is formed of a glass-filament epoxy-resinous material.

7. The combination according to claim 1, wherein there is provided a pair of additional lowermost separate, liquid completely-confined interrupting chambers (50, 51), through which the arc is drawn sequentially during the opening operation and additionally during the interruption of relatively-low-value currents.

8. The combination according to claim 2, wherein the interrupting cylinder has an elongated slot (45) provided therein to accommodate venting from the several venting passages.

9. The combination according to claim 1, wherein each grid-unit (5) comprises a plurality of stacked plate members, and one or more resilient, neoprene annular plate members are provided at the lower end of each grid-unit (5) for absorbing shock during the opening operation.

10. The combination according to claim 4, wherein each resistor assembly (58) is substantially 250 megohms in resistance value.

11. The combination according to claim 1, wherein the bottom apertured nozzle member (62) is formed of molded-glass polyester material.

12. The combination according to claim 1, wherein the vertical height of the vent openings (11, 12, 13) is substantially one-half the outside diameter of the movable contact rod (7).

* * * * *